313-414 SR
8/16/83 OR 4,399,388

United States Patent [19]
Hamano et al.
[11] 4,399,388
[45] Aug. 16, 1983

[54] PICTURE TUBE WITH AN ELECTRON GUN HAVING NON-CIRCULAR APERTURE

[75] Inventors: Eizaburo Hamano, Kumagaya; Shinpei Koshigoe; Eiji Kamohara, both of Fukaya, Japan

[73] Assignee: Tokyo Shibaura Denki Kabushiki Kaisha, Kawasaki, Japan

[21] Appl. No.: 197,643

[22] Filed: Oct. 16, 1980

[51] Int. Cl.³ ..... H01J 29/46; H01J 29/50; H01J 29/56

[52] U.S. Cl. ..... 313/414; 313/449; 313/460

[58] Field of Search ..... 313/460, 449, 414

[56] References Cited

U.S. PATENT DOCUMENTS

| | | | |
|---|---|---|---|
| 3,497,763 | 2/1970 | Hasker | 313/449 |
| 3,524,094 | 8/1970 | Hasker et al. | 313/471 |
| 3,919,583 | 11/1975 | Hasker et al. | 313/414 X |
| 4,143,293 | 3/1979 | Hosokoshi et al. | 313/414 X |
| 4,322,655 | 3/1982 | Takenaka et al. | 313/449 X |

FOREIGN PATENT DOCUMENTS

| | | | |
|---|---|---|---|
| 54-150961 | 11/1979 | Japan | 313/449 |
| 1421865 | 1/1976 | United Kingdom . | |

*Primary Examiner*—Palmer C. Demeo
*Attorney, Agent, or Firm*—Schuyler, Banner, Birch, McKie & Beckett

[57] ABSTRACT

In a picture tube comprising an envelope including a phosphor screen and an electron gun generating an electron beam, wherein the electron beam is deflected by magnetic deflecting fields, the electron gun comprising a triode section and a focusing section along a path of the electron beam, the triode sections being provided with an electrode containing a non-circular aperture having major and minor axes of symmetry, the major axis being parallel to a horizontal direction the focusing section having a means for forming an electrostatic focusing lens having a vertical focal length and a horizontal focal length, said vertical focal length more elongated than said horizontal focal length.

10 Claims, 8 Drawing Figures

PICTURE TUBE WITH AN ELECTRON GUN HAVING NON-CIRCULAR APERTURE

BACKGROUND OF THE INVENTION

This invention relates to a picture tube and more particularly to a color picture tube with an electron gun having non-circular apertures.

In a shadow mask type color tube, it is possible to converge three electron beams on a screen by means of a non-uniform magnetic deflection field without the use of a separate convergence coil. This deflecting field should consist of both a pincushion-shaped horizontal deflecting field for causing the three beams to be substantially converged along the horizontal axis and a barrel-shaped vertical deflecting field for causing the beams to be substantially converged along the vertical axis. While both the pincushion-shaped and barrel-shaped fields cause each of the three beams to focus in front of the phosphor screen on the side facing the electron gun (i.e., over focus) in the vertical direction, both fields cause each of the three beams to focus behind the phosphor screen (i.e., under focus) in the horizontal direction.

These focusing differences in both the horizontal and vertical directions affect the electron current distribution of the beam itself which causes coma aberration. The coma aberration due to the pincushion-shaped field can be overcome by adjusting a focusing voltage applied to the focusing electrode of the electron gun. The coma aberration however, caused by the barrel-shaped field remains unaffected.

As illustrated in FIG. 1, an electron beam 1 generated from an electron gun 2 has an electron current distribution comprising a high current density portion 3 at the center and a low current density portion 4 around the high current density portion 3. As the beam approaches the phosphor screen 5, it passes through the barrel-shaped vertical deflection field 6. In the vertical direction, the electrons positioned near the center of the deflecting field 9 are subject to a stronger deflecting force than the electrons positioned away from the center of the field. Therefore, the beam will be focused in front of the screen as shown by focal point 7 (i.e., over focus). Consequently, the beam spot on the screen at the periphery thereof is elongated, and comprises a high current density portion 3 and a tail-shaped haze portion 8 around the high density portion 3.

Reducing the coma aberration can be obtained by using a large lens or a complex focusing lens. Any reduction in aberration, however, produced by such structure will be restricted by the size of the electrodes that can be used with the narrow neck color picture tubes currently used.

The instant invention overcomes coma aberration by utilizing an electron gun which comprises a triode section and a focusing section; each of these sections being provided with at least one electrode containing a non-circular aperture having major and minor axes of symmetry. An electrostatic focusing lens formed by electrodes contains a non-circular aperture electrode within the focusing section for elongating the focal length in the vertical direction (i.e., vertical focal length) to a greater degree than the focal length in the horizontal direction (i.e., horizontal focal length).

The major axis of the non-circular aperture within the triode section is positioned substantially parallel to the horizontal direction. While the use of non-circular apertures are known in the prior art, they have been used other than disclosed by the instant invention. For example, U.S. Pat. No. 3,497,763 discloses the use of a single non-circular aperture in a picture tube to compensate for the astigmatic effect caused by a quadrupolar lens used for deflection amplification. U.S. Pat. No. 3,524,094 discloses a picture tube which generates a narrow elongated spot and the use of a single non-circular aperture to minimize the twist of the spot during deflection. British Pat. No. 1,421,865 discloses the use of two noncircular aperture in the triode of the electron gun to obtain a narrow elongated spot for an indexing-type tube.

SUMMARY OF THE INVENTION

It is an object of this invention to provide a picture tube with an electron gun structure for reducing coma aberration at the periphery or corners of the screen.

According to one aspect of this invention, a picture tube comprises an envelope with a panel containing a phosphor screen on its inner wall and an electron gun. The electron gun generates an electron beam which scans the phosphor screen and is deflected by a beam deflecting system in both horizontal and vertical directions along the phosphor screen. The electron gun comprises a cathode for emitting the electron beam, a triode section and a focusing section wherein each of these sections contain electrodes placed along the path of the electron beam. At least one of the electrodes within the triode section contains a non-circular aperture having a major axis and minor axis of symmetry, the major axis of the non-circular aperture in the triode section is positioned substantially parallel to the horizontal direction.

The electrostatic focusing lens has the vertical focal length being more elongated than the horizontal focal length. This lens is formed by a non-circular aperture electrode and an electrode facing the non-circular aperture. The vertical focal length being longer than the horizontal focal length of the electrostatic focusing lens is obtained by means of the major axis of the non-circular aperture being positioned substantially parallel to the vertical direction in the focusing section and by the application of a voltage means. The voltage means applies a lower voltage to this non-circular aperture electrode than the voltage applied to the electrode facing this non-circular aperture electrode.

In a further embodiment, at least one of the non-circular apertures within the triode section has a major axis positioned substantially parallel to the horizontal direction. Furthermore, at least one of the non-circular apertures within the focusing section has a major axis substantially parallel to the horizontal direction. A higher voltage is applied to this non-circular aperture electrode within the focusing section than the voltage applied to the electrode facing this non-circular aperture.

DETAILED DESCRIPTION OF THE PREFERRED EMBODIMENT

Figure 2:
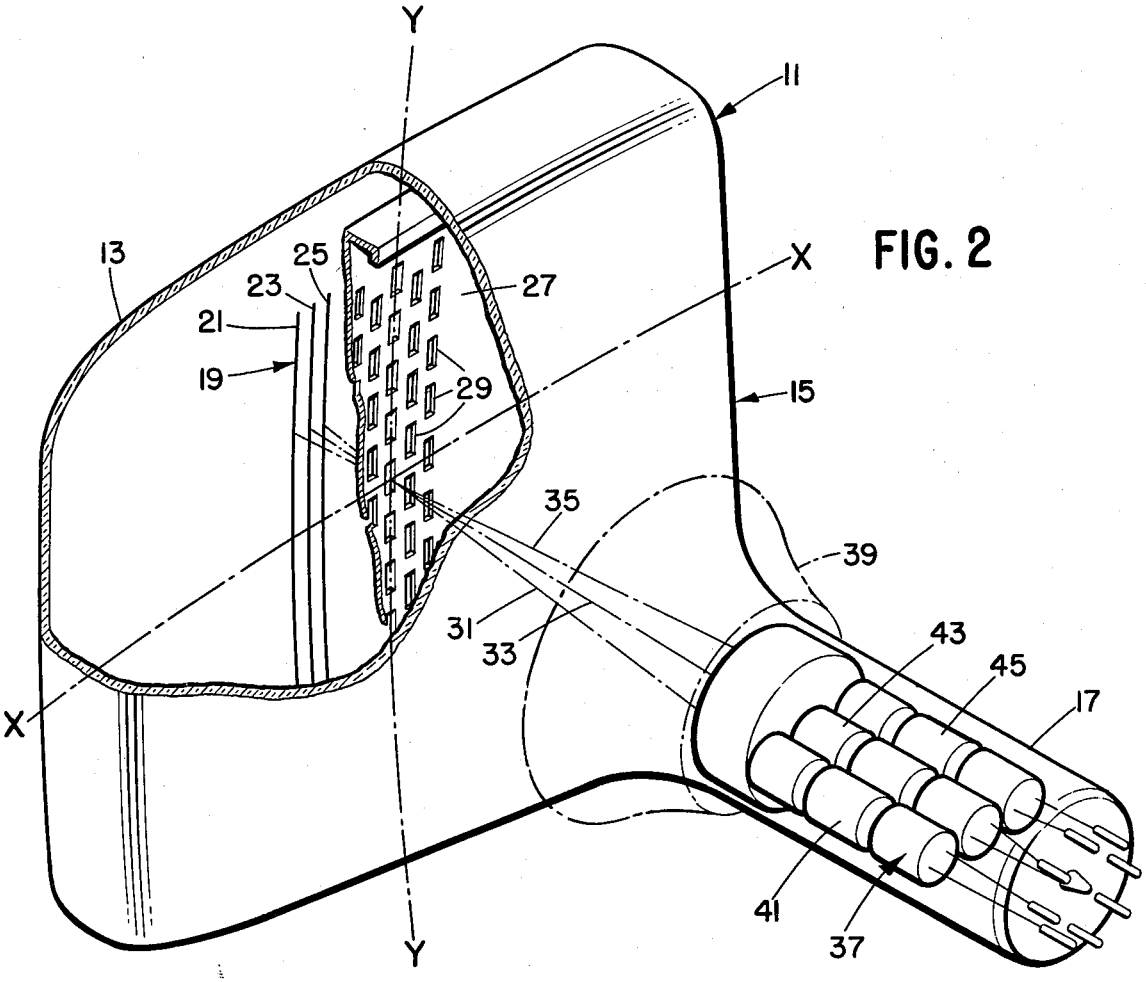
FIG. 2 is a perspective, partially in section, of a color picture tube embodying this invention.

Referring to the drawings, wherein like reference numerals designate identical corresponding parts of the embodiment, and more particularly to FIG. 2 thereof. FIG. 2 shows a shadow-mask type color picture tube of the invention comprising a glass envelope 11 which comprises a panel 13, a funnel portion 15 extending from panel 13, and a neck portion 17 extending from funnel portion 15.

On the inner wall of panel 13 there is a phosphor screen 19 containing a combination of phosphor stripes 21, 23 and 25 emitting red, green and blue light, respectively. A color selecting electrode (i.e., a shadow-mask 27) is positioned close to the phosphor screen 19 within the panel 13. The color selecting electrode 27 is provided with a plurality of slots 29 for selecting electron beams 31, 33 and 35 generated from an electron gun 37 within neck portion 17. The electron beams will impinge the phosphor screen 19 after passing through a magnetic deflecting field and slots 29. The deflecting field is formed by deflecting coils 39 attached to the outside of funnel portion 15 and neck portion 17, for deflecting the beams in both a horizontal direction X and a vertical direction Y.

Figure 5:
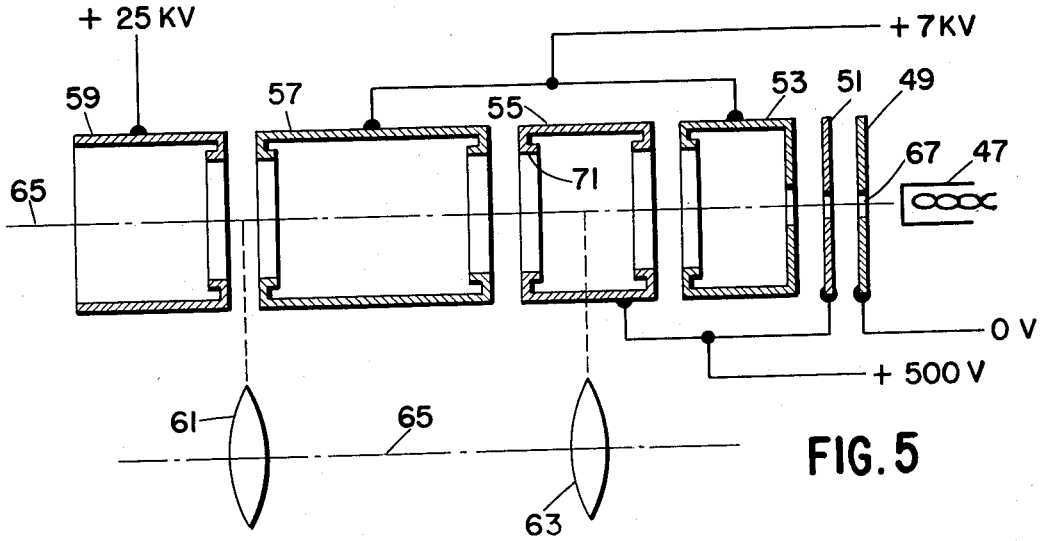
FIG. 5 is an axial sectional view of an electron gun embodying this invention with the schematic association of the main lens and sub-lens formed by the focusing section.

Electron gun 37 comprises three electron gun units 41, 43 and 45 (see FIG. 2) arranged in a line (i.e., the X direction). One of these units is shown in detail in FIG. 5. Each electron gun unit comprises a cathode 47, a first electrode 49, a second electrode 51, a third electrode 53, a fourth electrode 55, a fifth electrode 57 and a sixth electrode 59. Cathode 47 and first and second electrode 49 and 51, respectively, constitute a triode section. The third through sixth electrodes 53–59 constitute a focusing section. First and second electrode 49 and 51 have a plate-like shape and the third through sixth electrodes 53–59 have a cylindrical shape. The second and the fourth electrodes 51 and 55 are interconnected and the third and the fifth electrodes 53 and 57 are interconnected. Sixth electrode 59 is connected to a wall electrode (not shown) disposed on the inner wall of funnel portion 15. In operation, 25 KV (i.e., anode voltage) is applied to the sixth electrode 59, 7 KV (i.e., focus voltage) is applied to the third and fifth electrodes 53 and 57, and 500 V is applied to the second and the fourth electrodes 51 and 55. As illustrated in FIG. 5, the focusing section forms both a main electrostatic focusing lens 61 of a bi-potential type between electrodes 57 and 59, and a sub-electrostatic focusing lens 63 of a uni-potential type among electrodes 53–57 along path 65 of the electron beam.

In such a composite lens system, the electron beam 31 generated by cathode 47 is focused by sub-lens 63 before being focused by main lens 61. Sub-lens 63 functions to reduce the spherical aberration of the electron beam.

Figure 3:
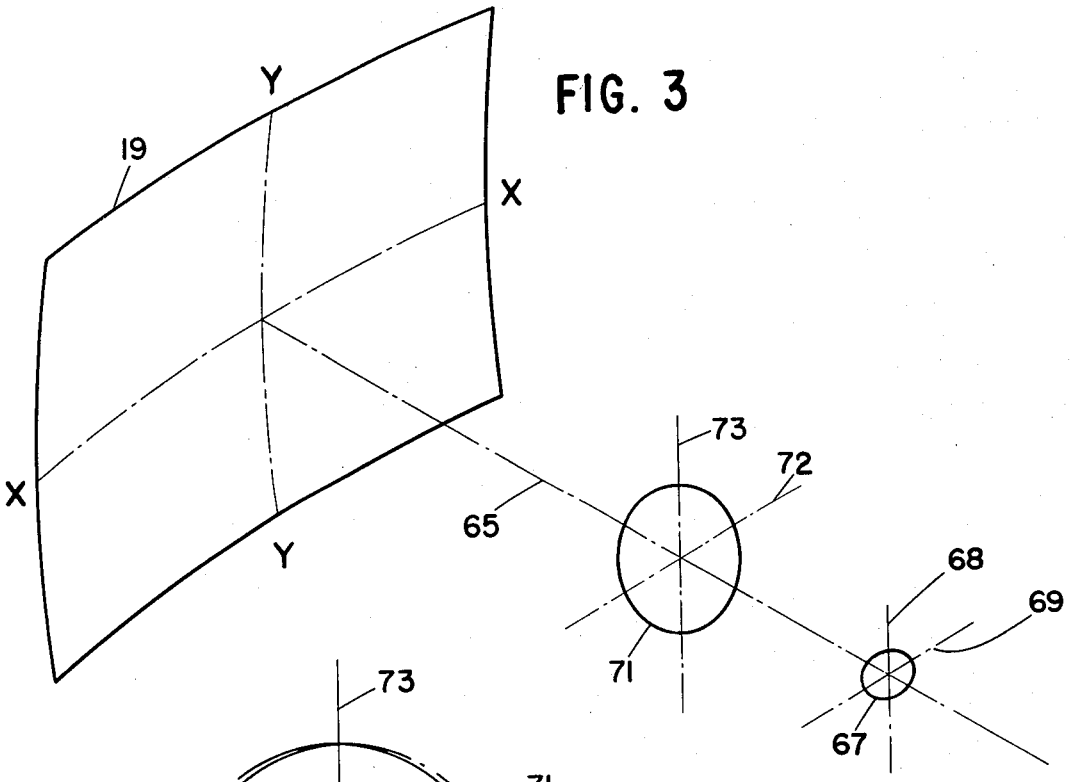
FIG. 3 is a schematic illustration showing the relative position and orientation of the non-circular apertures of this invention.
Figure 4:
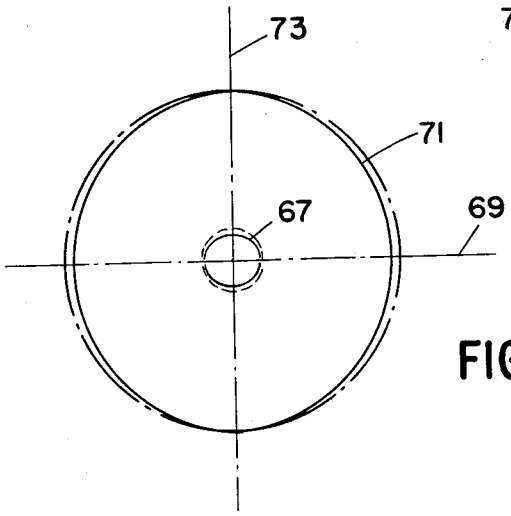
FIG. 4 is another schematic illustration showing the elevational aspect of the non-circular apertures of this invention superimposed.

As shown in FIGS. 3 and 4, electrode 49 within the triode section contains a non-circular aperture 67 (e.g., having an elliptical or rectangular shape) having a major axis 69 and minor axis 68. Electrode 55 within the focusing section contains a non-circular aperture 71 (e.g., an elliptical or rectangular shape) on the side facing fifth electrode 57; aperture 71 also contains a major axis 73 and minor axis 72. Aperture 67 has dimensions of 0.65 to 0.7 mm (major diameter) and 0.6 mm (minor diameter), while aperture 71 has dimensions of 5.55 to 5.6 mm (major diameter) and 5.5 mm (minor diameter). All the other apertures of the electrodes are circular. As shown in FIG. 3, major axis 69 of aperture 67 is positioned substantially at a right angle with respect to the major axis 73 of aperture 71. Furthermore, major axis 73 is positioned substantially parallel to vertical direction Y which causes sub-focus lens 63 to be a non-rotationally symmetrical lens. As a result, the amount of electron beam focusing in the vertical direction is smaller than the focusing in the horizontal direction; consequently, the vertical focal length will be more elongated than the horizontal focal length.

Figure 1:
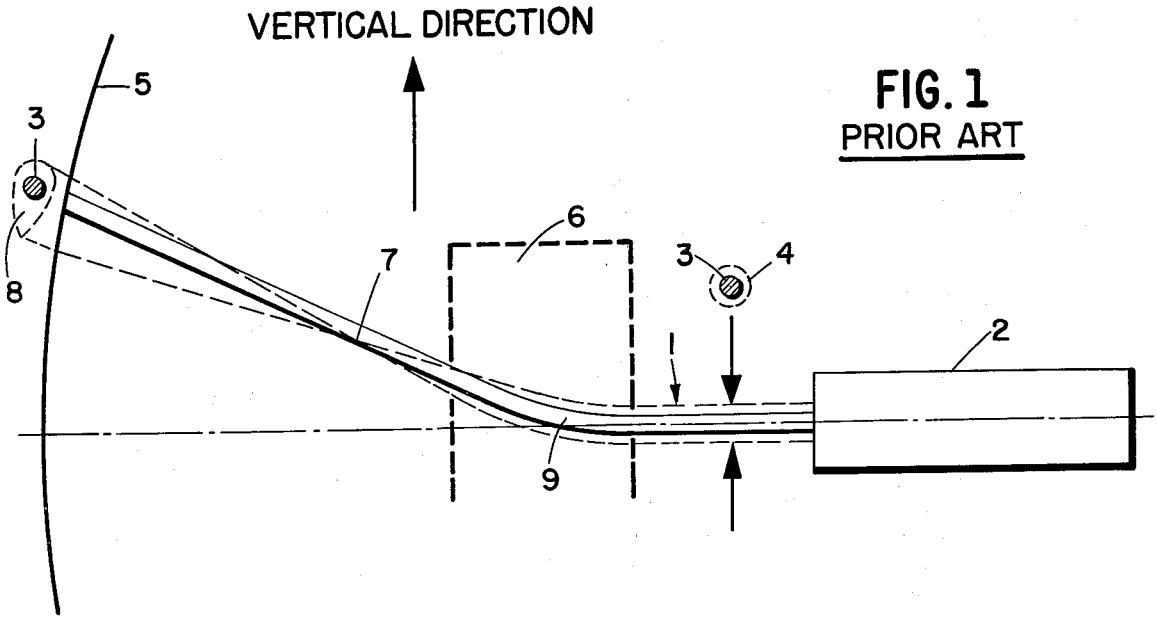
FIG. 1 PRIOR ART
FIG. 1 is a schematic illustration of an electron beam generated by a prior art electron gun.

As previously mentioned, the instant invention is utilized with a vertical deflecting field having a barrel-shaped configuration. Due to such a field, the electron beam is subject to over-focusing in the vertical direction as it passes through the field, as shown by the position of focal point 7 in FIG. 1; as a result, coma aberration of the low density portion is produced. The instant invention, however, reduces the coma aberration by making the vertical focal length of the focusing section longer than the horizontal focal length; consequently, the focal point 7 of the beam in the vertical direction approaches the screen. In other words, the instant invention makes it possible to control the position of the focal spot in order for it to be focused on the screen. As a result, the coma aberration is reduced even at the corner or periphery of the screen.

This non-rotationally symmetric sub lens 63 produces an electron beam having a cross section which is longitudinally elongated; consequently the beam spot on the center of the screen will be slightly non-circular. However, since the major axis 69 of non-circular aperture 67 of the electrode 49 is parallel with the horizontal direction X, the electron beam is given a cross section which is horizontally elongated before being focused by the focusing section. Utilizing non-circular electrode 49 in combination with non-circular 71 tends to compensate for any non-circularity of the beam spot.

As mentioned above, non-circular apertures are utilized, one in the triode section (i.e., electrode 49) and one in the focusing section (i.e., electrode 55). Moreover, the use of non-circular apertures are also applicable to the other electrodes within the focusing section. The non-circular apertured electrode within the focusing section causes the vertical focal length of the formed lens to be elongated when the aperture of the lower voltage electrode facing the higher voltage electrode is non-circular and the major axis is positioned parallel to the vertical direction. For example, this is shown in FIGS. 3–5 where major axis 73 of aperture 71 of the lower voltage electrode facing the higher voltage electrode is positioned parallel to the vertical direction.

Also, for example, the aperture of either the fourth electrode 55 which faces the third electrode 53 or the fifth electrode 57 which faces the sixth electrode 59 can be made non-circular.

Alternatively, since there must be at least two non-circular apertures, the first, second and fourth electrodes 49, 51 and 55, respectively, can also contain non-circular apertures.

Figure 6:
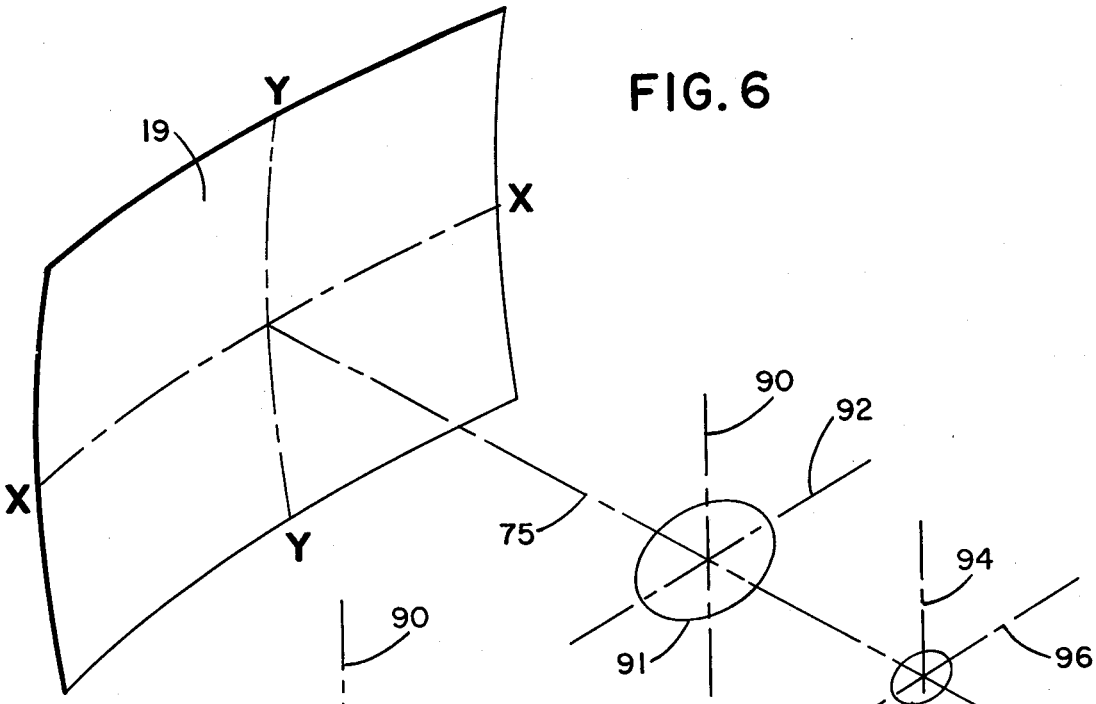
FIG. 6 is a schematic illustration showing the relative position and orientation of the non-circular apertures of another embodiment.
Figure 7:
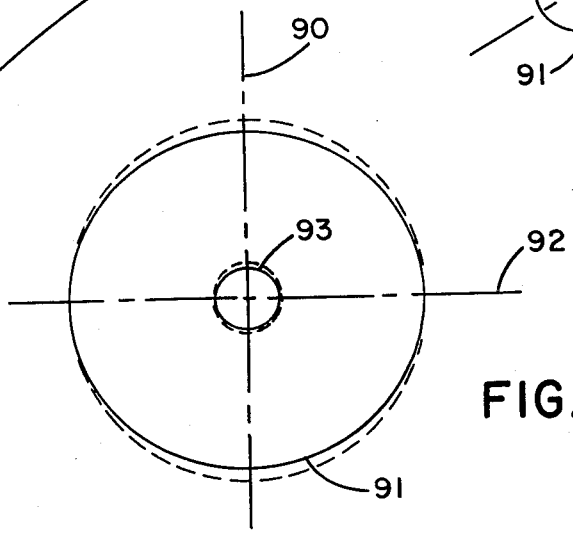
FIG. 7 is another schematic illustration showing the elevational aspect of the non-circular apertures of another embodiment superimposed.
Figure 8:
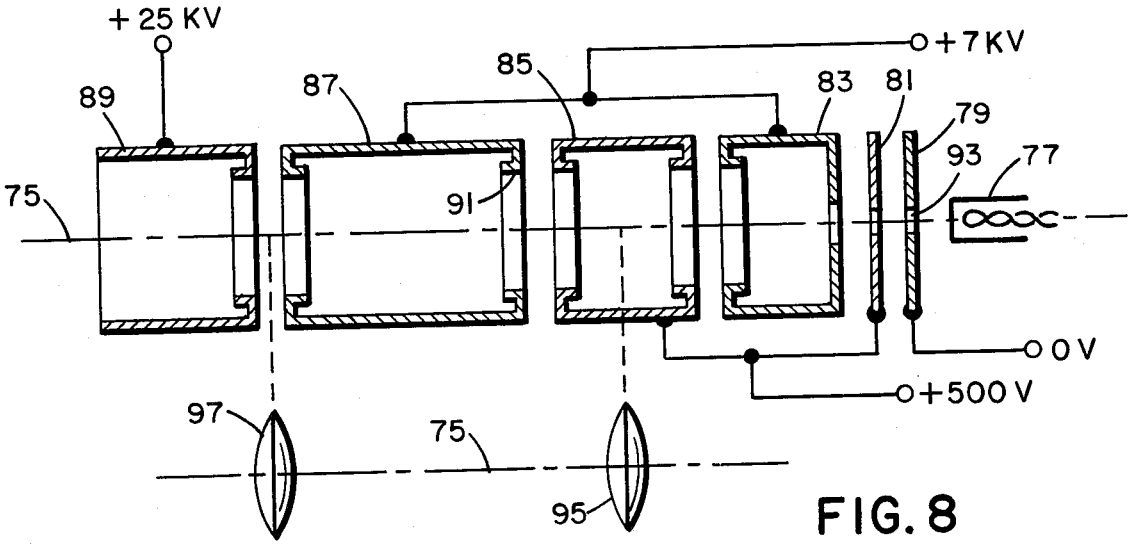
FIG. 8 is an axial sectional view of an electron gun utilizing another embodiment of this invention.

Furthermore, the use of a non-circular aperture in the focusing section can also reduce coma aberration when the aperture of the higher voltage electrode facing the lower voltage electrode is non-circular and its major axis is positioned parallel to the horizontal direction. As a result, the vertical focal length of the formed lens is elongated as in the case when the non-circular aperture of the lower voltage electrode facing the higher voltage electrode has its major axis positioned parallel to the vertical direction. The embodiment shown in FIGS. 6, 7 and 8 is similar to the previous embodiments expect the positioning of the major axis of the non-circular aperture in the focusing section. The non-circular aperture 91 within the focusing section is provided on the fifth electrode 87 at the side facing fourth electrode 85. Non-circular aperture 91 has a major axis 92 and a minor axis 90, with major axis 92 positioned substantially parallel to the horizontal direction X. For example, either the aperture of the third electrode 83 which faces the fourth electrode 85 or the aperture of the sixth electrode 89 which faces the fifth electrode 87 can be made non-circular.

Although not necessary for operation of the invention, it is desirable that the particular non-circular shape and dimension of the aperture of the second electrode 51 be the same as or substantially similar to the non-circular aperture of the first electrode 49. It should be noted, that the major axis of the non-circular apertured electrode within the triode section should be positioned substantially parallel to the horizontal direction.

It should be understood that according to the invention, an electron beam having a very narrow width can be obtained, and beam spots without coma aberration can be obtained at the periphery of the screen.

It should also be understood that the invention can be used in many types of electron guns, i.e., uni-potential, tri-potential and periodic potential. In fact, any electron gun comprising a triode section and a focusing section can obtain the benefits of the invention by utilizing at least two non-circular apertures.

It should be further understood that the invention can be applied to an unitary type electron gun in lieu of a discrete type electron gun.

We claim:

1. A picture tube comprising:

an envelope containing a panel;

a phosphor screen on the inner wall of said panel;

an electron gun for generating an electron beam having a substantially circular cross-sectional shape for scanning said phosphor screen in both vertical and horizontal directions, said electron gun comprising a triode section emitting said electron beam, which section has at least one electrode having a non-circular aperture containing major and minor axes of symmetry, said major axis being positioned substantially parallel to said horizontal direction and a focusing section for focusing said electron beam, which has a plurality of electrodes placed along a path of said electron beam, and;

said focusing section having a means for forming an electrostatic focusing lens having a vertical focal length and a horizontal focal length, said vertical focal length more elongated than said horizontal focal length, said focusing section having at least two electrodes facing each other for forming an electrostatic focusing lens along the path of said electron beam, one of said electrodes having a non-circular aperture containing major and minor axes of symmetry, said major axis of said one electrode within said focusing section being positioned substantially parallel to said vertical direction, and a voltage means for applying a lower voltage to said one electrode within said focusing section than the voltage applied to said other facing electrode in said focusing section.

2. A picture tube comprising:

an envelope containing a panel;

a phosphor screen on the inner wall of said panel;

an electron gun for generating an electron beam for scanning said phosphor screen in both vertical and horizontal directions, said electron gun comprising a triode section emitting said electron beam, which section has at least one electrode having a non-circular aperture containing major and minor axes of symmetry, said major axis being positioned substantially parallel to said horizontal direction and a focusing section for focusing said electron beam, which has a plurality of electrodes placed along a path of said electron beam;

said focusing section having a means for forming an electrostatic focusing lens having a vertical focal length and a horizontal focal length, said vertical focal length more elongated than said horizontal focal length; and said focusing section having at least two electrodes facing each other for forming an electrostatic focusing lens along the path of said electron beam, one of said electrodes having a non-circular aperture containing major and minor axes of symmetry, said major axis of said non-circular aperture of said one electrode within said focusing section being positioned substantially at a right angle with said vertical direction, and a voltage means for applying a higher voltage to said one electrode within said focusing section than the voltage applied to said other focusing electrode in said focusing section.

3. A picture tube comprising:

an envelope containing a panel;

a phosphor screen on the inner wall of said panel;

a means for generating an electron beam having a substantially circular cross-sectional shape which scans said phosphor screen, said means for generating comprising a cathode emitting said electron beam, a triode section and a focusing section wherein each of said sections contains a plurality of electrodes and at least one electrode within each of said sections contains a non-circular aperture having major and minor axes of symmetry through which said electron beam passes, at least one of said non-circular apertures within said focusing section having a major axis positioned parallel to said vertical direction and at least one of said non-circular apertures within the triode section having a major axis positioned parallel to said horizontal direction.

4. A picture tube comprising:

an envelope containing a panel;

a phosphor screen on the inner wall of said panel;

a means for generating an electron beam having a substantially circular cross-sectional shape which scans said phosphor screen, said means for generating comprising a cathode emitting said electron beam, a triode section and a focusing section wherein each of said sections contain a plurality of electrodes and at least one electrode within each of said sections contains a non-circular aperture having major and minor axes of symmetry through which said electron beam passes, a beam deflecting system for deflecting said electron beam in both a horizontal and a vertical direction; and at least one of said non-circular apertures within said focusing section having a major axis positioned parallel to said horizontal direction and at least one of said non-circular apertures within said triode section having a major axis positioned parallel to said horizontal direction.

5. The picture tube of claims 3 or 4 wherein said apertures have an elliptical shape.

6. The picture tube of claims 3 or 4 wherein said phosphor screen comprising a plurality of substantially parallel phosphor stripes extending along said vertical direction.

7. The picture tube of claims 3 or 4 wherein said phosphor stripes are made of three phosphors emitting red, green and blue lights respectively.

8. The picture tube of claims 3 or 4, wherein said electron beam generating means comprises three electron guns arranged in a line substantially parallel to said horizontal direction.

9. A picture tube comprising:

an envelope containing a panel;

a phosphor screen on the inner wall of said panel; and, a color selecting electrode situated near said phosphor screen;

a means for generating a plurality of electron beams substantially in a horizontal line for scanning said phosphor screen, each of said beams having a substantially circular cross-sectional shape, said electron generating means comprising a plurality of electron gun units each unit corresponding to a respective electron beam, and comprising a triode section and a focusing section placed along a path of said electron beam;

a beam deflecting system comprising a vertical field and horizontal field for magnetically deflecting said electron beams in both a horizontal direction and a vertical direction respectively, said vertical deflecting field having a barrel-shaped configuration;

wherein at least one electrode within each of said sections has a non-circular aperture which contains major and minor axes of symmetry, and each major axis being positioned substantially at right angle with at least one other major axis, and wherein at least one of said non-circular apertures within said focusing section has a major axis positioned parallel to said vertical direction.

10. A picture tube comprising:

an envelope containing a panel;

a phosphor screen on the inner wall of said panel; and, a color selecting electrode situated nearby said phosphor screen;

a means for generating a plurality of electron beams substantially in a horizontal line for scanning said phosphor screen, each of said beams having a substantially circular cross-sectional shape, said electron generating means comprising a plurality of electron gun units each unit corresponding to a respective electron beam, and comprising a triode section and a focusing section placed along a path of said electron beam;

a beam deflecting system comprising a vertical field and horizontal field for magnetically deflecting said electron beams in both a horizontal direction and a vertical direction respectively, said vertical deflecting field having a barrel-shaped configuration;

wherein at least one electrode within each of said sections has a non-circular aperture which contains major and minor axes of symmetry, and each major axis being positioned substantially parallel with at least one other major axis, and wherein at least one of said non-circular apertures within said focusing section has a major axis positioned parallel to said horizontal direction.

* * * * *